US011135703B2

(12) United States Patent
Norton et al.

(10) Patent No.: US 11,135,703 B2
(45) Date of Patent: Oct. 5, 2021

(54) DEVICE USED TO TEMPORARILY RESTRAIN PARTS AND ASSEMBLIES THROUGH MANUFACTURING PROCESSES

(71) Applicant: Ford Motor Company, Dearborn, MI (US)

(72) Inventors: Thomas Norton, Ann Arbor, MI (US); Mikhail Minevich, Livonia, MI (US); Vladimir Bogachuk, West Bloomfield, MI (US)

(73) Assignee: Ford Motor Company, Dearborn, MI (US)

( * ) Notice: Subject to any disclaimer, the term of this patent is extended or adjusted under 35 U.S.C. 154(b) by 197 days.

(21) Appl. No.: 15/989,429

(22) Filed: May 25, 2018

(65) Prior Publication Data

US 2019/0358782 A1 Nov. 28, 2019

(51) Int. Cl.

| | |
|---|---|
| ***B25B 11/00*** | (2006.01) |
| *B05C 13/02* | (2006.01) |
| *C25D 17/06* | (2006.01) |

(52) U.S. Cl.

CPC ..... *B25B 11/00* (2013.01); *B05C 13/02* (2013.01); *C25D 17/06* (2013.01)

(58) Field of Classification Search

CPC ..... B25B 11/00; B25B 11/02; B25B 33/00; B25B 9/00; B05C 13/02; C25D 17/06; B23Q 3/002; B23Q 3/101

USPC ..... 269/3; 248/500, 506, 680

See application file for complete search history.

(56) References Cited

U.S. PATENT DOCUMENTS

| | | | | |
|---|---|---|---|---|
| 4,781,488 | A * | 11/1988 | Hayashi | H05K 7/142 174/138 D |
| 5,368,427 | A * | 11/1994 | Pfaffinger | F16B 21/04 24/580.1 |
| 5,765,959 | A * | 6/1998 | Shioda | E05B 79/12 403/192 |
| 8,567,012 | B2 * | 10/2013 | Ng | E05C 17/203 16/86 C |
| 9,267,525 | B2 * | 2/2016 | Everard | F16B 21/02 |
| 2004/0244683 | A1 | 12/2004 | Beckord | |
| 2010/0201054 | A1 | 8/2010 | Perche | |

FOREIGN PATENT DOCUMENTS

| | | |
|---|---|---|
| DE | 3835810 | 4/1990 |
| DE | 20311091 | 10/2003 |
| FR | 2889227 | 2/2007 |

* cited by examiner

*Primary Examiner* — Michael D Jennings
*Assistant Examiner* — Alberto Saenz
(74) *Attorney, Agent, or Firm* — Burris Law, PLLC

(57) ABSTRACT

A temporary restraining device is provided that includes a head portion, a central body positioned below the head portion, an upper gap defined between the head portion and the central body, and a base portion positioned below the central body, a lower gap defined between the base portion and the central body. The temporary restraining device maintains a predetermined offset between workpieces disposed within the upper and lower gaps for subsequent manufacturing operations.

18 Claims, 6 Drawing Sheets

DEVICE USED TO TEMPORARILY RESTRAIN PARTS AND ASSEMBLIES THROUGH MANUFACTURING PROCESSES

FIELD

The present disclosure relates generally to restraining devices and more particularly to restraining devices that temporarily fix automotive parts to a body of a vehicle during manufacturing processes.

BACKGROUND

The statements in this section merely provide background information related to the present disclosure and may not constitute prior art.

Temporary restraining devices are generally used to affix components/parts to each other at predetermined distances during certain stages of a manufacturing process. In automotive applications, parts may be slaved over, or nearby other assemblies during manufacturing processes. An example would be an aluminum automotive roof being slaved on a steel body through an e-coating process. In this application, the roof needs to be constrained to the body, with limited contact, so that maximum e-coat coverage can be achieved. In the case of mixed material applications, thermal expansion differences often present challenges due to different relative movements of individual parts, in which the parts may come into contact and damage one another.

These challenges with properly restraining components in a temporary manner while undergoing various manufacturing processes, and particularly in an automotive e-coating process, among other issues with temporarily restraining components, is addressed by the present disclosure.

SUMMARY

The present disclosure provides a temporary restraining device comprising a head portion, a central body positioned below the head portion, and an upper gap defined between the head portion and the central body. A base portion is positioned below the central body and defines a stop, and a lower gap is defined between the base portion and the central body. The temporary restraining device maintains a predetermined offset between workpieces disposed within the upper and lower gaps for subsequent manufacturing operations.

In one form, the temporary restraining device is a single, unitized part. In additional variations, the stop is wider than a thickness of the central body, the central body is symmetrical about a longitudinal axis of the temporary restraining device, and the head portion is asymmetrically disposed about a longitudinal axis of the temporary restraining device. In one form, a handle is operatively engaged with the base portion and may be integral with the base portion.

In additional forms, the head portion defines an upper stop, the upper gap, the lower gap, and a position of the stop of the base portion are predetermined in order to accommodate movement of the plurality of workpieces in subsequent operations, the head portion and the central body each define a width that is narrower than receiving apertures within the plurality of workpieces, and the temporary restraining device is electrically conductive.

The present disclosure further provides an assembly comprising a plurality of workpieces and a temporary restraining device. The temporary restraining device comprises a head portion, a central body positioned below and aligned with the head portion, and an upper gap defined between the head portion and the central body. A base portion is positioned below the central body and defines a stop, and a lower gap is defined between the base portion and the central body. The temporary restraining device maintains a predetermined offset between the plurality of workpieces disposed within the upper and lower gaps for subsequent manufacturing operations.

In one form, at least two of the workpieces define receiving apertures configured to receive the head portion and the central body. The receiving apertures may be elongated slots having a width wider than each of the head portion and the central body. In other forms, the temporary restraining device is an electrically nonconductive material, the stop is wider than a thickness of the central body, and the head portion defines an upper stop.

The present disclosure further provides a method of restraining a plurality of workpieces comprising inserting a temporary restraining device through apertures in at least two of the workpieces, the temporary restraining device comprising a head portion and a central body positioned below and aligned with the head portion, wherein an upper gap is defined between the central body and the head portion. The temporary restraining device further comprises a base portion positioned below the central body and defining a stop, and a lower gap is defined between the base portion and the central body. The method next includes abutting the stop of the base portion against at least one workpiece and rotating the temporary restraining device until the central body and the head portion are at an angle relative to the apertures in the workpieces such that the temporary restraining device cannot be backed out.

In one form, the method is carried out manually. In another form, the temporary restraining device is rotated by a handle.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
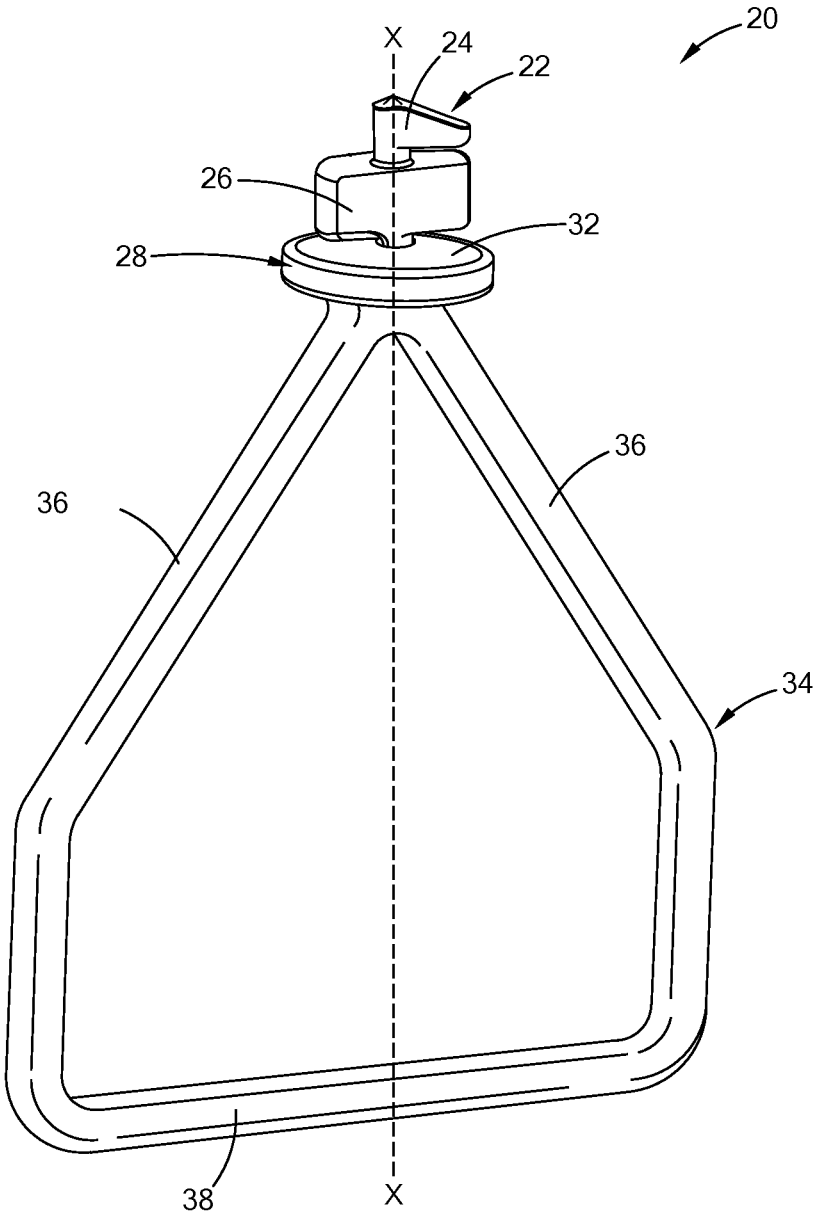
FIG. 1 is a perspective view of one form of a temporary restraining device according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2A:
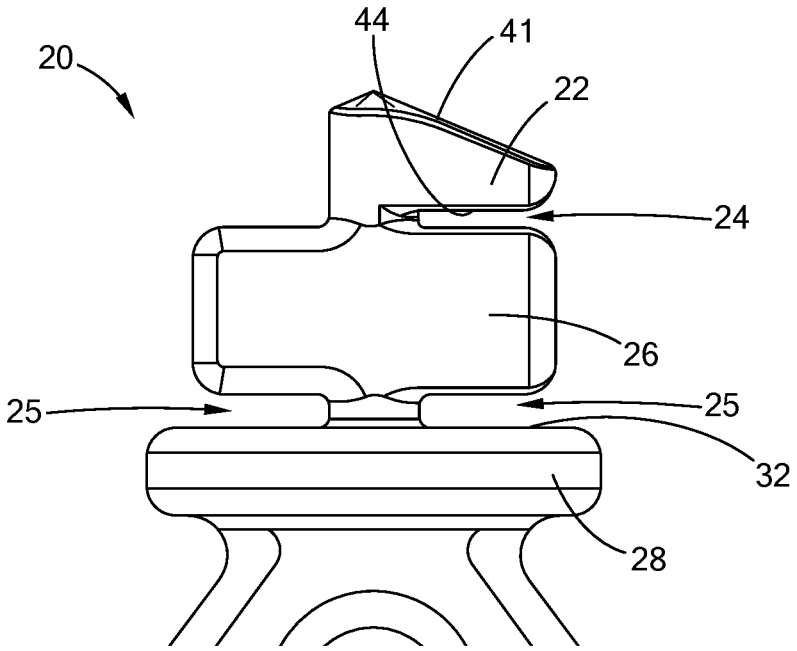
FIG. 2A is an enlarged side view of a head portion of the temporary restraining device of FIG. 1.

Referring to FIGS. 1 and 2A, a temporary restraining device according to the present disclosure is illustrated and generally indicated by reference numeral 20. The temporary restraining device 20 comprises a head portion 22, a central body 26 positioned below and aligned with the head portion 22, and an upper gap 24 defined between the head portion 22 and the central body 26. A base portion 28 is positioned below the central body 26, and a lower gap 25 is defined between the base portion 28 and the central body 26 as shown. The base portion 28 defines a stop 32, which in this form is a circular face that is normal to the base portion 28 and which is wider than the central body 26. As described in greater detail below, the temporary restraining device 20 is configured for translational and rotational placement between a plurality of workpieces to maintain a predetermined offset between the plurality of workpieces. More specifically, workpieces are disposed within the first and second gaps 24, 25, where they are separated by the central body 26.

In one form, the temporary restraining device 20 further includes a handle 34 which allows a user to place the temporary restraining device 20 between the plurality of workpieces (shown and described below) without the use of a secondary tool. The handle 34, disposed generally under the base portion 28, is operatively engaged with the base portion 28 such that as the handle turns or moves, the base portion 28 and the remainder of the temporary restraining device 20 moves as well. Although the handle 34 is shown as integrally formed with the temporary restraining device 20, the handle 34 may be a separate component that is fastened to the temporary restraining device 20 while remaining within the scope of the present disclosure. In this form, the handle 34 includes a pair of arms 36 extending from the base portion 28 and a cross-member 38 that joins the pair of arms 36.

As further shown, the head portion 22 is asymmetrically disposed about a longitudinal axis X of the temporary restraining device 20, and the central body 26 is symmetrically disposed about the longitudinal axis X of the temporary restraining device 20. It should be understood, however, that the head portion 22 and central body 26 are not limited to this specific configuration, and thus other geometrical configurations having functional features as described herein may also be employed while remaining within the scope of the present disclosure. For example, an alternate form includes both the head portion 22 and the central body 26 symmetrically disposed about the longitudinal axis X of the temporary restraining device 20, and vice-versa, while each of the head portion 22 and the central body 26 may take on different geometrical profiles other than triangular and rectangular as illustrated herein.

As shown in FIG. 2A, the head portion 22 defines an angled surface 41 configured to accommodate the geometry of a workpiece when one of the workpieces is disposed at an incline relative to an adjacent workpiece, which is described in greater detail below. The angled surface 41 provides for a proper clearance to an adjacent workpiece when the temporary restraining device 20 is translated and rotated within workpieces. Accordingly, the head portion 22 may define a surface, or multiple surfaces, which are configured to accommodate specific geometry of a workpiece so that the temporary restraining device 20 can freely translate and rotate. Therefore, it should be understood that the linear, angled surface 41 is exemplary and should not be construed as limiting the scope of the present disclosure.

Figure 2B:
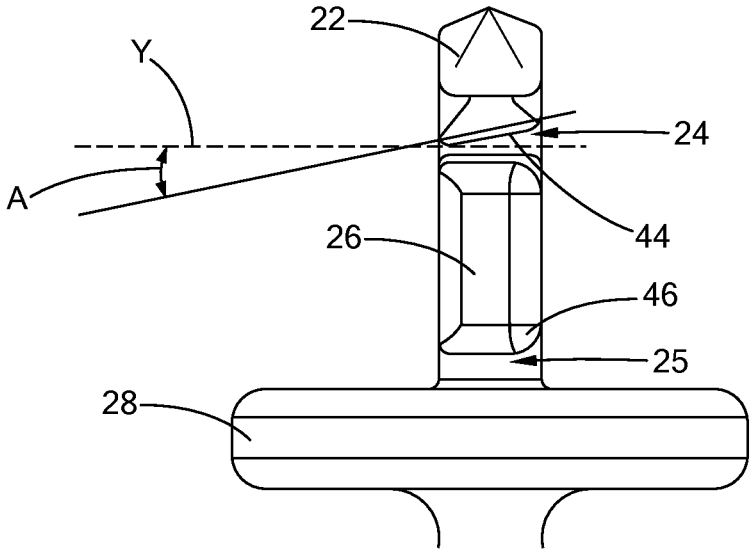
FIG. 2B is an enlarged front view of a head portion of the temporary restraining device of FIG. 1.

With further reference to FIG. 2B, the upper gap 24 is disposed between the head portion 22 and the central body 26 and is sized to receive at least one of the plurality of workpieces. Similarly, the lower gap 25 is disposed between the central body 26 and the base portion 28 and is sized to receive at least one of the plurality of workpieces.

In one form, the upper gap 24 includes at least one tapered surface 44. The tapered surface 44 is at an angle A relative to a central axis Y of the upper gap 24. The tapered surface 44 provides the upper gap 24 with a wider opening to better facilitate engagement with one or more of the plurality of workpieces when the temporary restraining device 20 is rotated, which is described in greater detail below. It should be understood that the tapered surface 44 is optional, and thus the upper gap 24 may also define a constant width while remaining within the scope of the present disclosure.

As further shown, central body 26 may include radiused edges 46 to further facilitate receiving one or more workpieces.

The upper gap 24, lower gap 25, a position of the stop 32 of the base portion, and the angled surface 41 of the head portion 22 are predetermined in order to accommodate movement of the plurality of workpieces in subsequent operations, such as in an e-coating process. More specifically, the width of the upper gap 24 and the lower gap 25 correspond with nominal widths of respective workpieces that are positioned therein, plus an additional amount of space that allows for thermal expansion of the workpieces during the e-coat process. For example, if a workpiece (e.g., aluminum roof) has a thickness of 0.125 inches, the nominal gap dimension would be about 0.150 inches, to allow for thermal growth during the e-coat process. Thermal expansion will vary depending on not only workpiece thickness, but also the overall shape and mass of the workpiece, and thus the dimensions for the upper and lower gaps 24/25 may be designed specifically for a given application. Alternatively, the dimensions for the upper and lower gaps 24/25 may be sized to accommodate multiple workpiece thicknesses and geometries while being able to maintain the restraining function, as described in greater detail below.

Figure 3:
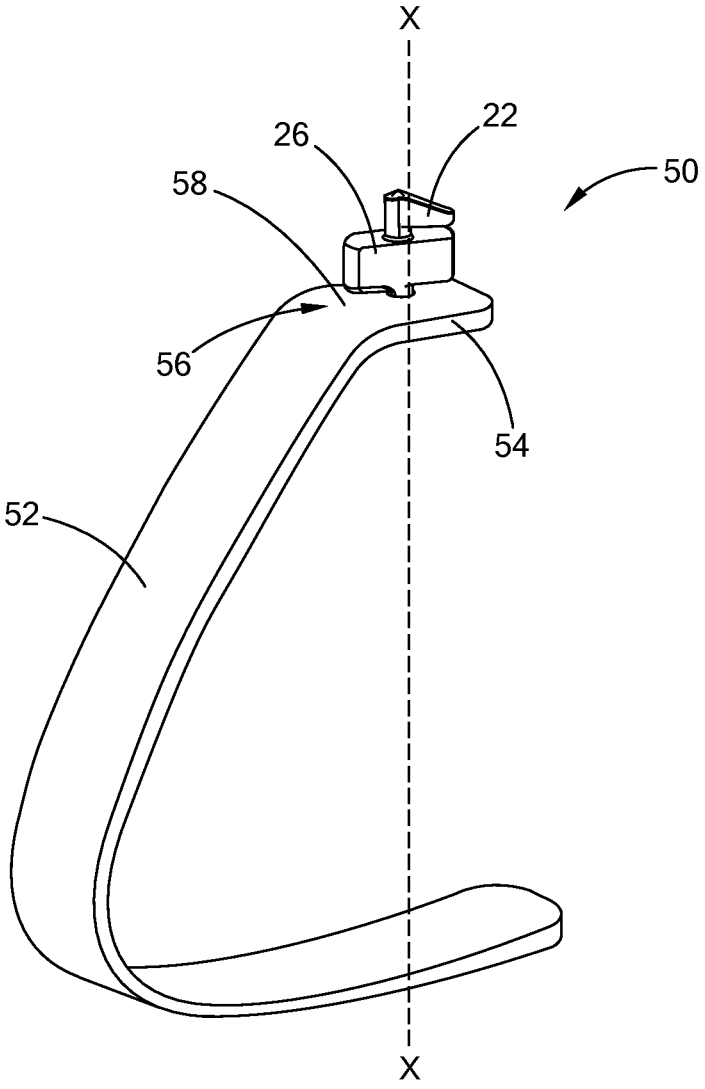
FIG. 3 is a perspective view of another form of a temporary restraining device according to the present disclosure.

Referring to FIG. 3, another form of a temporary restraining device having a different handle configuration is illustrated and generally indicated by reference numeral 50. In this form, the temporary restraining device 50 includes a handle 52 that extends from a base portion 54 and an upper portion 56 of the handle 52, and also forms a portion of the stop 58. The handle in this form is asymmetrical about the longitudinal axis X of the temporary restraining device 50 and has a profile that extends outwardly on one side so as to not interfere with additional components of an assembly during operation/rotation.

In both forms, the base portion 28, 52 is wider than a thickness of the central body 26, and the head portion 22 and the central body 26 each define a width that is narrower than receiving apertures within the plurality of workpieces, which is illustrated and described in greater detail below.

The various forms of the temporary restraining device 20/50 as illustrated herein are shown as a single unitized part. It should be understood, however, that the temporary restraining device 20/50 may comprise a number of parts, for example, a separate head portion 22, central body 26, base portion 28/52 and/or handle 34/52 in place of a single unitized temporary restraining device 20/50 while remaining within the scope of the present disclosure.

The components of the temporary restraining devices 20/50 may be any of a variety of materials appropriate for subsequent manufacturing processes, and in one form, the temporary restraining devices 20/50 are electrically conductive. Alternatively, the temporary restraining devices 20/50 are electrically non-conductive. In still another form, some features may be electrically conductive and other electrically non-conductive, in addition to being made from different materials, rather than a single material. In one form, the restraining devices 20/50 are a high temperature polymer such as a polyimide, and in another form, the restraining devices 20/50 are a steel alloy material.

Figure 4A:
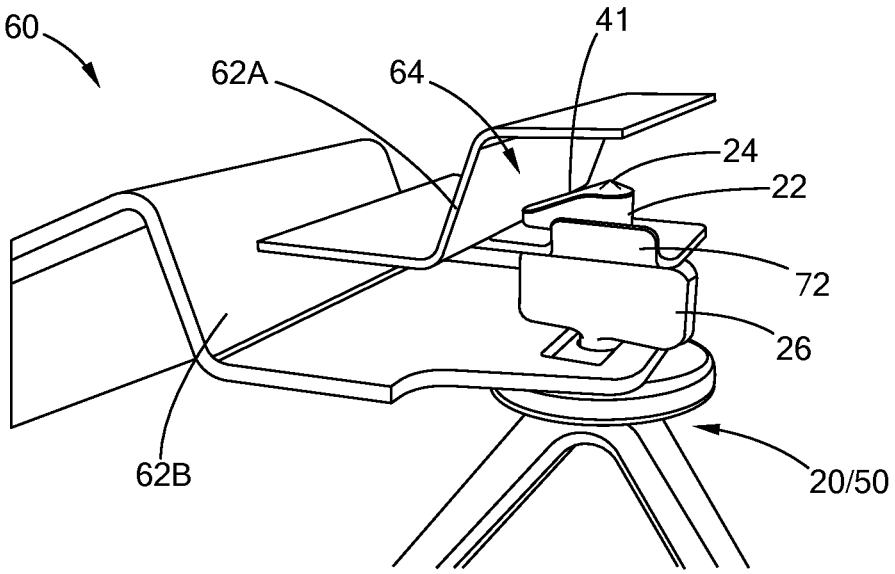
FIG. 4A is a side view of an assembly including a temporary restraining device inserted into a plurality of workpieces according to the present disclosure.
Figure 4B:
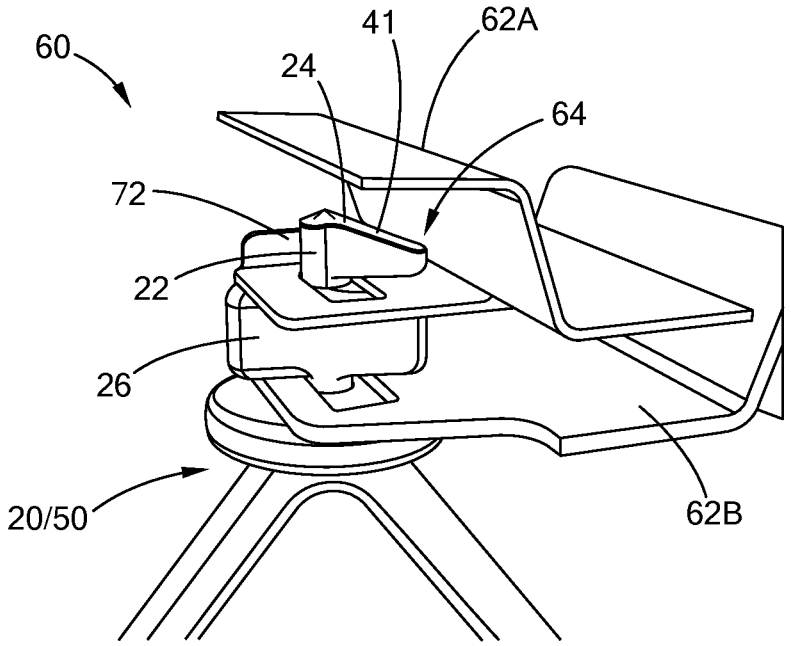
FIG. 4B is another side view of the assembly of FIG. 4A.
Figure 5:
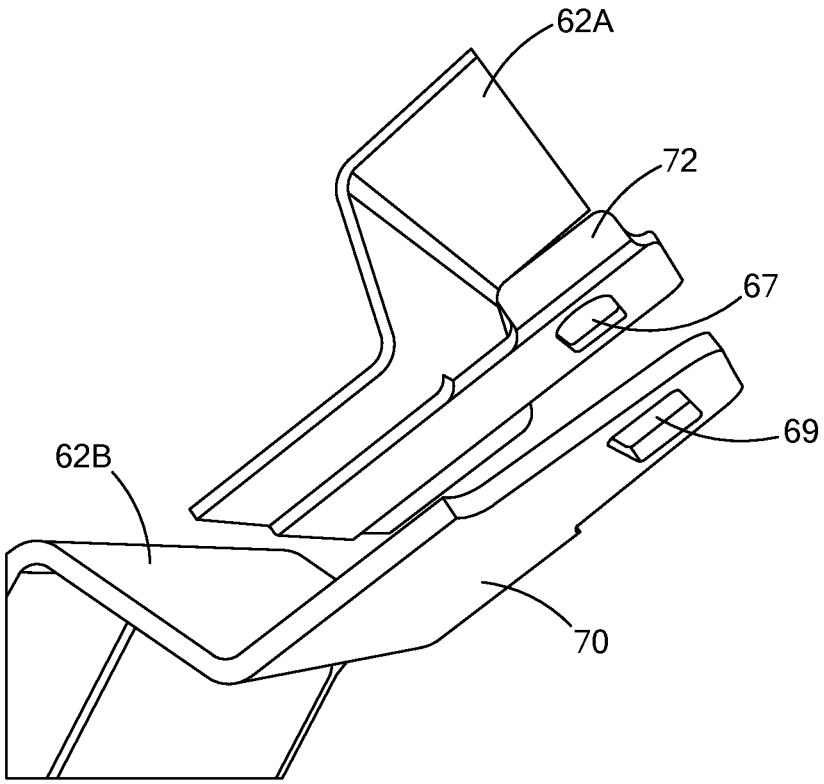
FIG. 5 is a perspective view of two workpieces, each having receiving apertures in the form of slots in accordance with the present disclosure.

Referring to FIGS. 4A, 4B, and 5, an assembly 60 and a method of restraining a plurality of workpieces with the temporary restraining device 20/50 is now described in greater detail. The assembly 60 includes the temporary restraining device 20/50 and a plurality of workpieces. For illustrative purposes, a first workpiece 62A, such as a roof panel, is disposed adjacent to a second workpiece 62B, such as a body panel. It should be understood, however, that these workpieces 62A and 62B are merely exemplary and that any number of workpieces having a variety of geometries may be temporarily restrained in accordance with the teachings of the present disclosure.

The first workpiece 62A defines a receiving aperture 67 configured to receive the head portion 22 of the temporary restraining device 20/50. Similarly, the second workpiece 62B defines a receiving aperture 69 configured to receive the head portion 22 of the temporary restraining device 20/50 and also the central body 26. In order to provide easy insertion, in one form, the receiving apertures 67 and 69 each define elongated slots having a width wider than a width of the head portion 22. Accordingly, the head portion 22 can be easily inserted through the receiving apertures 67 and 69. The width of the receiving aperture 69 of the second workpiece 62B is similarly wider than a width of the central body 26, such that the central body 26 can be easily inserted through the receiving aperture 69, but not necessarily through the receiving aperture 67.

As further shown, the first workpiece 62A includes a tab 72 that is configured to block or stop the head 22 of the temporary restraining device 20/50 during rotation such that further rotation is inhibited, which is described in greater detail below. Although the tab 72 is shown as an integral feature of the first workpiece 62A, the tab 72 may be a separate component, and may also take on any number of geometric shapes, while still remaining within the scope of the present disclosure.

Figure 6A:
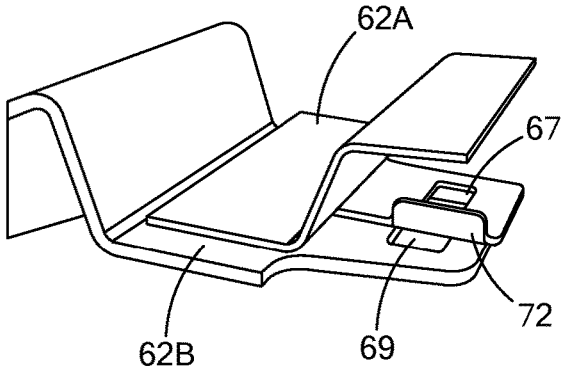
FIGS. 6A-6D are progressive illustrations of a method of restraining a plurality of workpieces with a temporary restraining device according to the present disclosure.
Figure 6B:
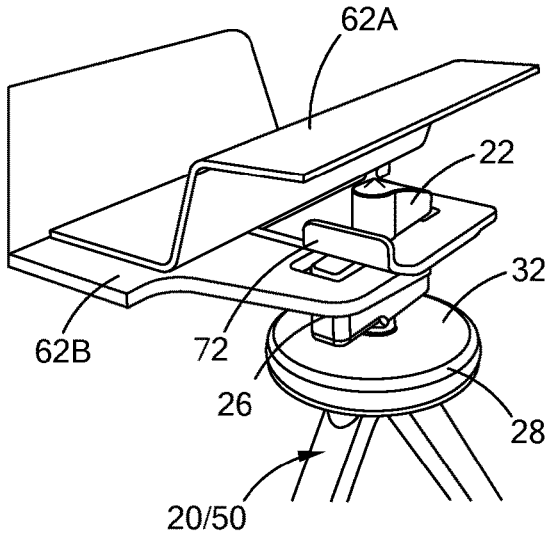

Referring now to FIGS. 6A-6D, installation of the temporary restraining device 20/50 is now shown and described in greater detail. As shown, the head portion 22 is inserted through the receiving aperture 69 of the second workpiece 62B. After the head portion 22 passes through this receiving aperture 69, the temporary restraining device 20/50 is further inserted such that the head portion 22 passes through the receiving aperture 67 of the first workpiece 62A, while the central portion 26 passes through the receiving aperture 69 of the second workpiece 62B until the stop 32 of the base portion 28 abuts an outer surface 70 of the second workpiece 62B. When the stop 32 abuts the second workpiece 62B, the first workpiece 62A is positioned in the upper gap 24, and the second workpiece 62B is positioned in the lower gap 25 (see also FIGS. 2A and 2B) such that the temporary restraining device 20/50 is free to rotate about its longitudinal axis X. As shown in FIG. 6B, the temporary restraining device 20/50 is in an unlocked position in which the head portion 22 and central body 26 are parallel with the elongated slots 67, 69 of the first and second workpieces 62A, 62B.

Figure 6C:
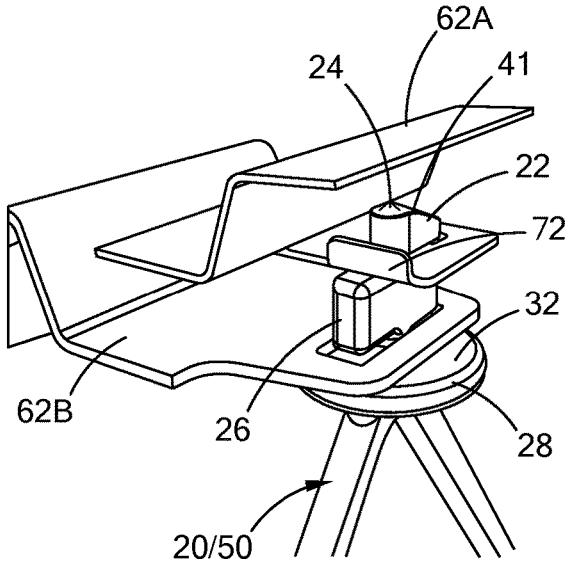
Figure 6D:
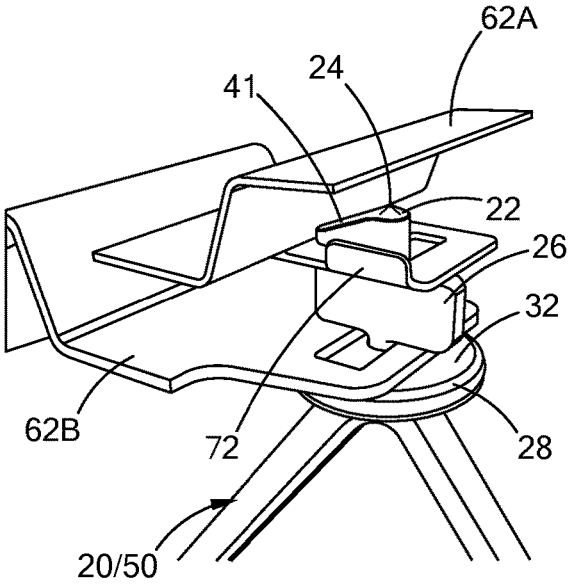

Referring to FIGS. 6C and 6D, the temporary restraining device 20/50 is rotated around the longitudinal axis X until a side of the head 22 engages the tab 72 of the first workpiece 62A, thus inhibiting further rotation and providing a haptic indication to an operator that the temporary restraining device 20/50 is properly positioned. In one form, the temporary restraining device 20/50 is rotated by the handle 34/52, which may be carried out manually. However, the temporary restraining device 20/50 may be rotated by use of a tool or machine depending on the application or subsequent manufacturing process.

The temporary restraining device 20/50 is now in a locked position in which the workpieces 62A/62B are held in place with a predetermined spacing without overly restricting movement of the workpieces. The spacing of the upper and lower gaps 24/25 relative to workpiece thicknesses allows the workpieces 62A/62B to move during thermal processing, which reduces the risk of contact and potential damage to the workpieces 62A/62.

Furthermore, the temporary restraining device 20/50 is configured for single-handed operation with a manual installation and defines an overall geometry in which an operator can install the device in a "blind" location. The temporary restraining device 20/50 is thus simple and easy to use in order to separate workpieces for subsequent manufacturing operations. After the workpieces are processed, an operator simply holds and rotates the handle 36/52 until the head portion 24 and the central body 26 are aligned with the apertures, and then translates the restraining device 20/50 away from the workpieces for removal.

The description of the disclosure is merely exemplary in nature and, thus, variations that do not depart from the substance of the disclosure are intended to be within the scope of the disclosure. Such variations are not to be regarded as a departure from the spirit and scope of the disclosure.

The invention claimed is:

1. A temporary restraining device comprising: a head portion; a central body positioned below the head portion, an upper gap defined between the head portion and the central body; and a base portion positioned below the central body, a lower gap defined between the base portion and the central body, wherein the temporary restraining device maintains a predetermined offset between workpieces disposed within the upper and lower gaps for subsequent manufacturing operations, the upper gap allowing a portion of the workpieces to be inserted therein, the temporary restraining device being rotatable between an unlocked position where the temporary restraining device is removable from the workpieces and a locked position where the temporary restraining device is prevented from being removed from the workpieces, and wherein the temporary restraining device is installed to the workpieces by inserting the head portion and the central body through elongated slots of the workpieces until the base portion abuts one of the workpieces, the head portion and the central body are disposed outside the elongated slots, and the workpieces are located in the upper and lower gaps, and by rotating the head portion and the central body to the locked position.

2. The temporary restraining device according to claim 1, wherein the temporary restraining device is a single, unitized part.

3. The temporary restraining device according to claim 1, wherein the base portion defines a stop.

4. The temporary restraining device according to claim 3, wherein the upper gap, the lower gap, and the stop of the base portion are configured to accommodate movement of the plurality of workpieces in subsequent operations.

5. The temporary restraining device according to claim 1, wherein the central body is symmetrical about a longitudinal axis of the temporary restraining device.

6. The temporary restraining device according to claim 1, wherein the head portion is asymmetrically disposed about a longitudinal axis of the temporary restraining device.

7. The temporary restraining device according to claim 1 further comprising a handle operatively engaged with the base portion.

8. The temporary restraining device according to claim 7, wherein the handle is integral with the base portion.

9. The temporary restraining device according to claim 1, wherein the upper gap is defined between a surface of the head portion and a surface of the body portion, one of the surfaces being a tapered surface to provide a wider opening to facilitate engagement with at least one of the workpieces when the temperature restraining device is rotated.

10. The temporary restraining device according to claim 1, wherein the temporary restraining device is electrically conductive.

11. The temporary restraining device according to claim 1, wherein the head portion and the central body each have a plate configuration, the head portion and the central body being parallel with the elongated slots during insertion of the head portion and the central body through the elongated slots of the workpieces.

12. An assembly comprising:

a plurality of workpieces; and a temporary restraining device comprising:

a head portion;

a central body positioned below and aligned with the head portion, an upper gap defined therebetween; and a base portion positioned below the central body and defining a stop, a lower gap defined therebetween, wherein the temporary restraining device maintains a predetermined offset between the plurality of workpieces disposed within the upper and lower gaps for subsequent manufacturing operations, the upper gap allowing a portion of the workpieces to be inserted therein, the temporary restraining device being rotatable between an unlocked position where the temporary restraining device is removable from the workpieces and a locked position where the temporary restraining device is prevented from being removed from the workpieces, wherein the head portion and the central body each define a width that is narrower than elongated slots of the workpieces such that the temporary restraining device is installed to the workpieces by inserting the head portion and the central body through the elongated slots of the workpieces until the base portion abuts one of the workpieces, the head portion and the central body are disposed outside the elongated slots, and the workpieces are located in the upper and lower gaps, and by rotating the head portion and the central body to the locked position.

13. The assembly according to claim 12, wherein temporary restraining device is an electrically nonconductive material.

14. The assembly according to claim 12, wherein the stop is wider than a thickness of the central body.

15. The assembly according to claim 12, wherein the upper gap is defined between a surface of the head portion and a surface of the body portion, one of the surfaces being a tapered surface to provide a wiper opening to facilitate engagement with at least one of the workpieces when the temperature restraining device is rotated.

16. A method of restraining a plurality of workpieces comprising:

inserting a temporary restraining device through elongated slots in at least two of the workpieces, the temporary restraining device comprising:

a head portion;

a central body positioned below and aligned with the head portion, an upper gap defined therebetween; and a base portion positioned below the central body and defining a stop, a lower gap defined therebetween;

abutting the stop of the base portion against at least one of the workpieces;

inserting portions of the at least two of the workpieces in the upper gap and the lower gap; and rotating the temporary restraining device between a locked position where the central body and the head portion are at an angle relative to the elongated slots such that the temporary restraining device cannot be backed out and an unlocked position where the temporary restraining device is removable from the workpieces, wherein the head portion and the central body each define a width that is narrower than the elongated slots such that the temporary restraining device is installed to the workpieces by inserting the head portion and the central body through the elongated slots until the base portion abuts one of the workpieces, the head portion and the central body are disposed outside the elongated slots, and the at least two of the workpieces are located in the upper and lower gaps, and by rotating the head portion and the central body to the locked position.

17. The method according to claim 16, wherein the method is carried out manually.

18. The method according to claim 16, wherein the temporary restraining device is rotated by a handle.

* * * * *